United States Patent [19]

Price

[11] 4,449,613

[45] May 22, 1984

[54] OIL DRAIN VALVE WITH REMOTE CONTROL MEANS

[76] Inventor: Ralph J. Price, 7636 Upper Miamisburg Rd., Miamisburg, Ohio 45342

[21] Appl. No.: 424,437

[22] Filed: Sep. 27, 1982

[51] Int. Cl.[3] ..... F01M 11/04

[52] U.S. Cl. ..... 184/1.5; 251/65; 251/129; 251/139

[58] Field of Search ..... 184/1.5; 251/144, 313, 251/65, 129, 139; 137/351

[56] References Cited

U.S. PATENT DOCUMENTS

| | | | |
|---|---|---|---|
| 1,539,914 | 6/1925 | Rhoades | 184/1.5 |
| 1,995,174 | 3/1935 | Gerrard et al. | 184/1.5 X |
| 2,095,696 | 10/1937 | Hackel | 184/1.5 X |
| 2,657,705 | 11/1953 | Gerhard et al. | 184/1.5 X |
| 3,310,133 | 3/1967 | Eaker | 184/1.5 |
| 3,586,044 | 6/1971 | Petersen | 251/139 X |
| 3,650,352 | 3/1972 | Schwary | 251/144 X |
| 3,677,369 | 7/1972 | Schramm | 184/1.5 |
| 3,954,250 | 5/1976 | Grace | 184/1.5 X |
| 4,086,981 | 5/1978 | Mitsui | 184/1.5 |
| 4,274,444 | 6/1981 | Ruyak | 251/65 X |
| 4,284,262 | 8/1981 | Ruyak | 251/65 |
| 4,319,664 | 3/1982 | Price | 184/1.5 |

FOREIGN PATENT DOCUMENTS

| | | | |
|---|---|---|---|
| 1417669 | 12/1975 | United Kingdom | 251/65 |

*Primary Examiner*—David H. Brown
*Attorney, Agent, or Firm*—Charles R. Wilson

[57] ABSTRACT

A remotely controlled oil drain valve assembly is provided. The assembly comprises a valve body which is threadably connected to the crankcase of an internal combustion engine. A valve core is slideably mounted within the valve body. Ports in the valve body and valve core, when in alignment, permit the flow of oil from the crankcase through a passageway in the valve core. The ports are brought in alignment by means mounted in the valve body which receive an electric signal from a remote source to cause rotation of the valve core to the proper position.

5 Claims, 3 Drawing Figures

OIL DRAIN VALVE WITH REMOTE CONTROL MEANS

BACKGROUND OF THE INVENTION

This invention relates to an improved oil drain valve assembly. More particularly, the invention relates to an oil drain valve assembly having remote control operating means.

Internal combustion engines which are in commercial use are typically equipped with an oil drain plug mounted in the bottom of the engine. When the oil in the engine needs to be changed, the drain plug is removed and the oil drains by gravity out of the engine. Unfortunately, in the case of an automobile, removing the drain plug is rather burdensome to the individual without hydraulic lift means. Crawling under the automobile or having to drive the automobile up onto a ramp have their obvious disadvantages.

Several attempts have been made to construct oil drain valves which can be controlled by remote means and thus avoid the problems attendant with the conventional oil drain plug. Such attempts, however, have not found widespread acceptance for a variety of reasons, including reliability, ease of design and manufacture, and compactness. Examples of these previous attempts can be found described in U.S. Pat. Nos.: 3,477,459; 3,650,352; 3,677,369; 3,954,250; 4,086,981; and 4,319,664.

There has now been found a remotely controlled oil drain valve assembly usable with an internal combustion engine which is free of many of the drawbacks associated with known remote control drain valves. The present oil drain valve assembly is characterized in being relatively easy to manufacture due to its limited number of parts, yet is reliable. It can be installed merely by removing the conventional threaded drain plug and substituting the oil drain valve assembly of this invention.

SUMMARY OF THE INVENTION

The remotely controlled oil drain valve assembly of this invention comprises a valve body, a valve core, and operating means for remotely controlling the valve core. The valve body has a tubular section with external threads suitable for connection to a threaded opening in a crankcase, stepped cylindrical bases of two different diameters in juxtaposition below the threads and an opening in the larger diameter base through which a control wire can pass. The valve body further has an opening starting at the bottom surface of the larger diameter base, extending through the valve body and piercing the top portion thereof. A valve seat, formed within the valve body by the opening, has a truncated conical surface. The valve body also has a port through which oil can enter the valve body.

The valve core, which is slideably mounted in the valve body, has a shoulder for mating with the interior of the lesser diameter base found on the valve body. The valve core itself has a hollow member with a conical section extending from the shoulder with one end being truncated for reception into the truncated valve seat of the valve body. A tube member extends from the shoulder in the other direction. A protuberance on the top of the hollow member holds the valve core in the valve body when assembled. A port in the valve core is positioned such that when it is in registry with the port on the valve body, oil can pass from the crankcase through the two ports and into a passageway which extends through the valve core to its bottom. Means are mounted in the larger diameter base for effecting rotary motion to the valve core. An electrical switching device is used to remotely control the means mounted in the larger diameter base to rotate the valve core to an open position so that the port of the valve core and port of the valve body are in alignment for draining oil or to a close position so that the ports are out of alignment during normal engine operation.

DESCRIPTION OF THE DRAWINGS

For purposes of illustration, there is shown in the accompanying drawings the preferred embodiment of the invention. These drawings are for the purpose of illustration only and the invention is not limited thereto.

In the drawings.

DESCRIPTION OF THE INVENTION

Figure 1:
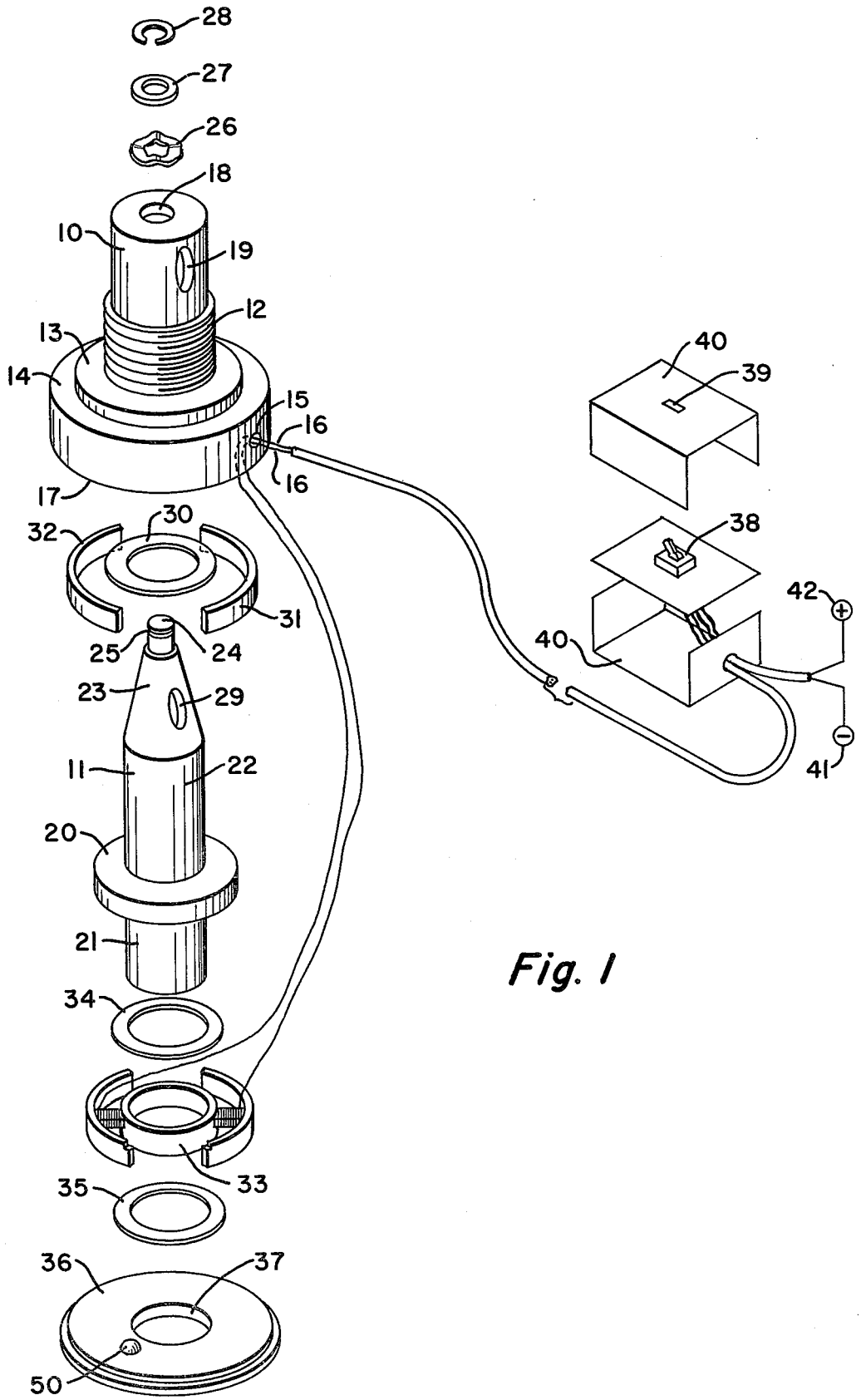
FIG. 1 is an exploded view of an oil drain valve assembly.
Figure 2:
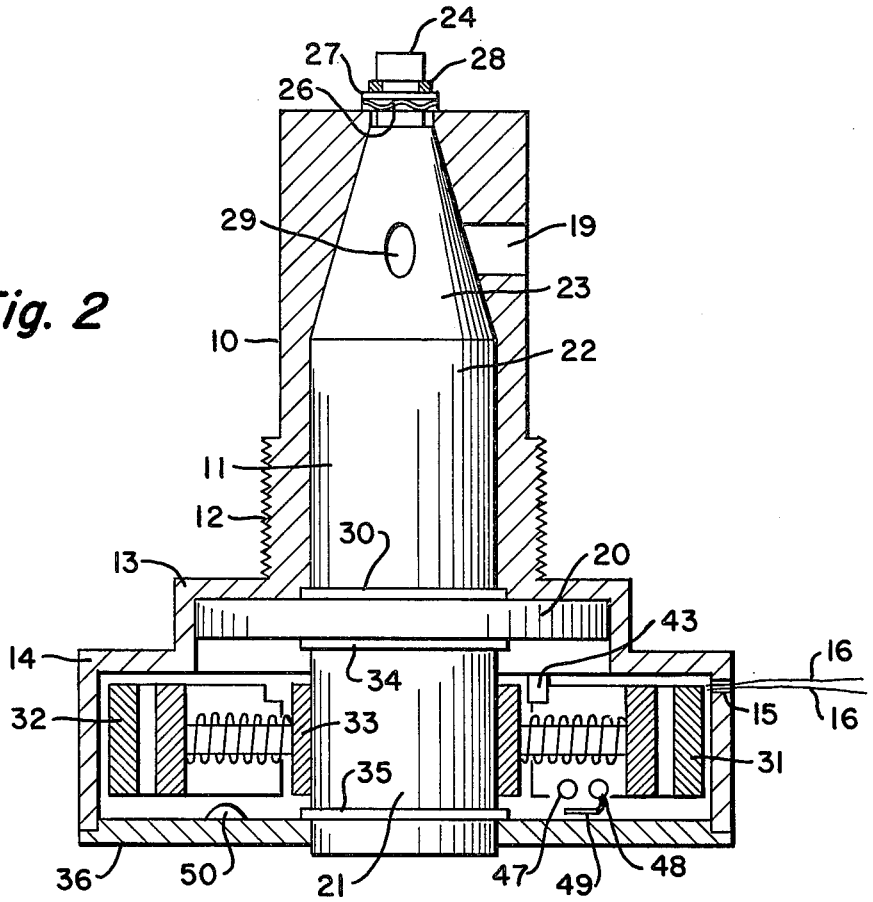
FIG. 2 is a partial cross-sectional view of the valve body and valve core of FIG. 1.

Referring now to FIG. 1, the oil drain valve comprises a valve body 10 and a valve core 11. The valve body 10 has a tubular section with external threads 12 suitable for connecting the valve body 10 to a threaded opening in the crankcase of an internal combustion engine. The top portion of the tubular section is designed to extend into the crankcase when the oil drain valve is installed and thus has a smaller diameter than that of the threaded section. The valve body 10 has two stepped cylindrical bases 13 and 14, of different diameters in juxtaposition one to another positioned below the external threads 12. The lesser diameter base 13 is in closest proximity to the external threads 12 and the larger diameter base 14 forms the bottom of the valve body 10. The larger diameter base 14 has an opening 15 through which control wires 16 can pass. That portion of the wires 16 which are outside the valve body 10 are, of course, insulated. An opening 17 starting at the bottom surface of the larger diameter base 14 and extending through the valve body 10 and piercing the top portion at opening 18 provides a valve seat in which the valve core 11 is slideably mounted. A port 19 is provided in the valve body 10 for the purpose of forming a passageway for oil in the crankcase to flow into the valve core 11 as described in more detail later. The valve seat within the valve body 10 has a truncated conical surface as best depicted in FIG. 2 with the narrow end in proximity of the top portion of the valve body 10. The truncated conical surface is shaped to mate with the valve core 11 so as to permit the valve core 11 to rotate within the valve seat, but at the same time, not permit oil to leak out.

The valve core 11 which is slideably mounted in the valve body 10 has a shoulder 20 of a size for mating with the interior of the lesser diameter base 13 of the valve body 10. Tube member 21 extends from the shoulder 20. The tube member 21 is of a length sufficient to extend at least to the bottom of the larger diameter base of the valve body 10 when the valve core 11 is mounted therewithin. The valve core 11 also has a hollow member 22 with a conical section 23 which extends in the other direction from the shoulder 20. Section 23 is truncated for reception in the truncated valve seat of the valve body 10. The end of the valve core 11 is a protuberance 24 which extends from the top of the truncated cone section for a length sufficient to fit through the opening 18 of the valve body 10 when the valve core 11 and valve body 10 are assembled together. The protuberance 24 has suitable means, such as a clip ring retaining groove 25, in combination with a wave spring washer 26, washer 27 and clip ring 28, for securing the valve core 11 and valve body 10 together to prevent vertical motion between the two. As discussed below, the securing means must allow for rotary motion of the valve core 11 in the valve body 10. The valve core 11 also has a port 29 which communicates with a passageway extending through the valve core 11 to the bottom of the tube member 21. Washer 30 of a diameter to fit over the hollow member provides a sealing function. A fiber gasket can optionally be positioned at the bottom of the threads for providing another sealing function.

Within the larger diameter base of the valve body 10 are mounted two field magnets 31 and 32. The inner face of one magnet, e.g., magnet 31, is a south pole while its outer face is a north pole. The other magnet's inner face is a north pole while its outer face is a south pole. An armature 33 made of a suitable material, e.g., soft iron, is securely fitted over tube member 21. An insulating washer 34 is placed on tube member 21 so as to be between the shoulder 30 and the armature 33. A second insulating washer 35 fits over the tube member 21 and insulates the armature 33 from the dust cap 36. An electric wire is wound arond the spokes of the armature 33 in a conventional manner. By way of illustration, each spoke can be wrapped with 250 turns of number 35 enamel insulated copper wire. More or less turns of wire can be used provided the product of current flow and number of turns is sufficient. The wire leads extend from the armature 33 through the opening 15 found in the larger diameter base 14 of the valve body 10 to a remote source of electricity. The dust cap 36 is a size sufficient to slideably fit onto the bottom of the larger diameter base 14. An opening 37 in the dust cap 36 is positioned to permit the tube member 21 to pass therethrough allowing said tube member 21 to be pressedly secured thereto thus providing a passageway for oil to flow through the valve core 11 and exit through the tube member 21.

The wires 16 which are connected to the armature 33 lead to switch means remotely located from the valve. For example, a double pole-double throw center off spring return switch 38 extends through an opening 39 in the top of the box 40 for easy access. The box 40 is securely mounted on and convenient stationary object such as the interior fender panel or firewall. The switch 38 has three positions: the on position which rotates the valve core 11 until its port and the port of the valve body 10 are in alignment; the off position which returns the valve core 11 to a position such that the ports are not in alignment; and the rest position where no further movement of the valve core 11 occurs. A wire 41 leading from the box 40 to a ground, for example the frame of the automobile, and a second wire 42 leading from the box 40 to the positive terminal of a storage battery completes the loop.

When the switch 38 is in the on position electricity is sent through the wire to the means in the larger diameter base 14, i.e., the armature 33. One shoe of the armature 33, e.g., that opposite magnet 32 becomes a north magnetic pole and the other shoe becomes a south magnetic pole. Since the inner face of magnet 32 is also a north magnetic pole and the inner face on magnet 31 is a south magnetic pole, magnetic repulsion results. This force of repulsion causes the armature 33 to rotate until one shoe strikes a stop. Placing the switch 38 in its center position breaks the flow of current to the armature 33. The armature 33 holds this new position because the shoes of the armature 33 are attracted to the magnets. Placing the switch 38 in the third position reverses the polarity of the shoes, thereby reversing the action and forcing the armature 33 to rotate in the other direction. Movement of the armature 33 necessarily causes the valve core 11 to rotate.

The assembled valve body 10 and valve core 11 is best shown in FIG. 2. As there shown, the valve core 11 and washers are not in sectional view while the rest of the assembly is in sectional view. The valve body 10 is comprised of the tubular section with external threads 12, the lesser diameter base 13 and the larger diameter base 14. The port 19 in the valve body 10 provides a passageway for oil in the crankcase to flow. The valve core 11 has the shoulder 20, the tube member 21, and the hollow member 22 with truncated conical section 23. Port 29 is shown in the figure as being not in alignment with port 19 and thus in the close position. Protuberance 24 is shown with spring washer 26, washer 27 and clip ring 28. Within the larger diameter base 14 is shown field magnets 31 and 32 operatively associated with the armature 33. Insulating washers 34 and 35 and sealing washer 30 are provided for their respective functions. Dust cap 36 is shown with tube member 21 extending through the opening 37 a short distance. There is shown a fragmentary view of the wires 16 extending through opening 15 in the larger diameter base 14.

Figure 3:
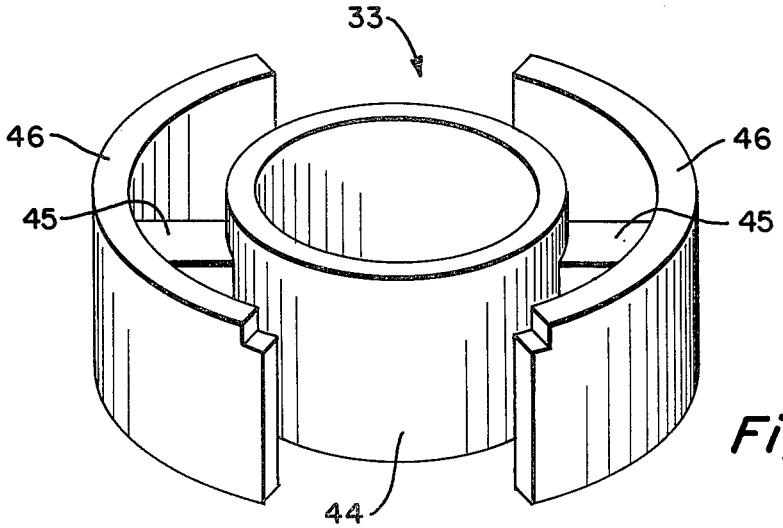
FIG. 3 is a view of an unwound armature used in the oil drain valve assembly of FIG. 1.

FIG. 3 is a view of the armature 33 without windings. The armature 33 comprises a hub 44, spokes 45 and shoes 46. The hub 44 is sized to fit securely over tube member 21 of the valve core 11. Preferably, notches are provided on the top corners of the shoes 46 for accommodating the stop 43 and thereby allowing for a full 90 degree swing. This permits complete alignment of the ports in the valve body 10 and valve core 11.

In operation, when it is desired to drain oil from the crankcase of an internal combustion engine fitted with the oil drain valve assembly of this invention, it is only necessary to move the switch 38 to the on position. This activates the armature 33, causing the shoes to move away from the field magnets 31 and 32. Because the armature 33 is securely mounted on the valve core 11, the valve core 11 is also caused to move until arrested by the stop 43 properly positioned in the larger diameter base 14. In this position the port 29 of the valve core 11 and the port 19 of the valve body 10 are in alignment. Oil in the crankcase thus flows through ports 19 and 29, through a passageway extending from the port 29 through the conical section 23 and the tube member 21 until it exits at the bottom of the tube member 21. Reversing the switch 38 causes the valve core 11 to rotate back to its original position where the ports 19 and 29 are not in alignment.

An optional feature which can be employed is a signal means for indicating when the valve ports are in alignment. For instance, an "internal switch" can be employed. Such a switch comprises wires 47 and 48 mounted on the interior of larger diameter base 14, a spring wire 49 connected to wire 48 and a properly positioned non-conductive riser 50 on the dust cap 36.

Wires 47 and 48 are connected to a source of electricity. In operation, when the valve core 11 is rotated, the riser 50 causes the spring wire 49 to make contact with wire 47. Wires 47 and 48 are connected to the switch 38 and a signal means, e.g., a light or light emitting diode which alerts the user as to the valve's open position.

It can be seen the oil drain valve assembly of this invention provides a reliable means for remotely draining oil from the crankcase of an internal combustion engine. For example, the plug valve does not unduly extend from the crankcase thereby increasing its chances of an accidental shearing. At the same time, the control mechanism for rotating the valve core is easily activated, yet will not accidently open.

The oil drain valve assembly of this invention is most useful when mounted in the crankcase of an automobile engine. It should be understood, though, the assembly can also be conveniently used with other internal combustion engines such as found in lawnmowers and farm equipment.

Various changes and modifications can be made to the described invention as will be obvious to those skilled in the art. Such changes and modifications are within the scope and teaching of the invention as defined by the following claims.

I claim:

1. A remotely controlled oil drain valve assembly for an internal combustion engine crankcase comprising:

(a) a valve body having a tubular section with external threads suitable for connection to a threaded opening in the crankcase, stepped cylindrical bases of two different diameters in juxtaposition below the threads, said lesser diameter base being in closest proximity to the threads and said larger diameter base forming the bottom of the valve body, further wherein the larger diameter base has an opening through which a source of electricity can pass, the valve body having an opening starting at the bottom surface of the larger diameter base, extending through the tubular section and piercing the top portion thereof, further wherein a valve seat formed within the valve body by the opening has a truncated conical surface with the narrow end in proximity of the top portion of the valve body and a port in the tubular section through which oil in the crankcase can flow;

(b) a valve core slideably mounted in the valve body, said valve core having a shoulder of a size for mating with the interior of the lesser diameter base found on the valve body, a tube member extending from the shoulder a length sufficient to extend at least to the bottom of the larger diameter base of the valve body when the valve core is mounted therewithin, and a hollow member with a conical section extending from the shoulder with the end farthest removed being truncated for reception in the truncated valve seat of the valve body and having a protuberance extending from the top of the truncated end of a length sufficient to fit through the opening on the top portion of the valve body, further wherein the protuberance has means for securing such that when the valve core is slideably mounted in the valve body it is secured from vertical motion by the securing means and further having a port rotatable into registry with the port in the valve body, said valve core port communicating with a passageway in the valve core which extends through the valve core to the bottom of the tube member;

(c) means within the larger diameter base for effecting rotary motion to the valve core in response to an electric signal from a remote source so as to rotate said core valve to an open position such that the valve core port is in alignment with the valve body port or to a close position such that the valve core port and valve body port are not in alignment; and (d) a dust cap of a size for securely fitting over the opening found in the bottom of valve body and having a hole into which the tube member of the valve core extends.

2. The drain valve assembly of claim 1 wherein the means within the larger diameter base of the valve body comprises an armature which is securely attached to the tube member, and a set of field magnets operatively associated with the armature, said armature receiving the electric signal through wires which pass through the opening in the larger diameter base from a source of electricity.

3. The drain valve assembly of claim 2 further comprising a stop positioned within the larger diameter base for arresting motion of the armature in response to the electric signal.

4. The drain valve assembly of claim 3 further comprising a spring return switch connected to the wires leading to the armature.

5. The drain valve assembly of claim 4 further comprising signal means for indicating when the ports of the valve body and valve core are in alignment.

* * * * *